US009691368B2

(12) United States Patent
Kang et al.

(10) Patent No.: US 9,691,368 B2
(45) Date of Patent: Jun. 27, 2017

(54) MULTIFUNCTIONAL DIGITAL MUSICAL INSTRUMENT

(71) Applicant: Cosmogenome Inc., Chuncheon-si, Gangwon-do (KR)

(72) Inventors: Jinhue Kang, Seoul (KR); Byeong Hee Kim, Chuncheon-si (KR); Youngho Seo, Chuncheon-si (KR)

(73) Assignee: Cosmogenome Inc. (KR)

( * ) Notice: Subject to any disclaimer, the term of this patent is extended or adjusted under 35 U.S.C. 154(b) by 0 days.

(21) Appl. No.: 15/002,268

(22) Filed: Jan. 20, 2016

(65) Prior Publication Data

US 2016/0210949 A1 Jul. 21, 2016

(30) Foreign Application Priority Data

Jan. 21, 2015 (KR) ..... 10-2015-0010284
Nov. 24, 2015 (KR) ..... 10-2015-0164410

(51) Int. Cl.
*G10H 7/00* (2006.01)
*G10H 1/32* (2006.01)
*G10H 1/055* (2006.01)

(52) U.S. Cl.
CPC ..... *G10H 1/32* (2013.01); *G10H 1/0551* (2013.01); *G10H 1/0555* (2013.01);
(Continued)

(58) Field of Classification Search
CPC ..... G10H 1/183; G10H 7/008; G10H 7/002; G10H 1/32; G10H 3/03; G10H 2210/325;
(Continued)

(56) References Cited

U.S. PATENT DOCUMENTS 5,668,340 A * 9/1997 Hashizume ..... G10D 9/005 84/723
6,005,181 A * 12/1999 Adams ..... G10H 1/0558 84/734
(Continued)

FOREIGN PATENT DOCUMENTS

JP 2013-164542 8/2013
JP 2013-164542 A 8/2013
(Continued)

*Primary Examiner* — Jeffrey Donels
(74) *Attorney, Agent, or Firm* — Innovation Counsel LLP

(57) ABSTRACT

An electronic musical instrument includes a database including timbre data corresponding to a plurality of musical instruments an acoustic data input unit configured to display an acoustic data input position corresponding to a selected one of the musical instruments, detect whether the acoustic data input position is touched, and receive information on the touched acoustic data input position a mouthpiece detachably provided and having a shape corresponding to a shape of a mouthpiece of the selected musical instrument a wind sensor unit configured to measure an amount of air to generate loudness data a control unit configured to receive timbre data corresponding to the information on the touched acoustic data input position, receive the loudness data from the wind sensor unit, and synthesize the timbre data and the loudness data to output an acoustic sound signal of the selected musical instrument and a power supply unit configured to supply power.

20 Claims, 14 Drawing Sheets

(52) U.S. Cl.
CPC ..... *G10H 1/0556* (2013.01); *G10H 2220/361* (2013.01); *G10H 2230/165* (2013.01); *G10H 2230/195* (2013.01)

(58) Field of Classification Search
CPC ..... G10H 2220/021; G10H 2220/361; G10H 2230/155
USPC ..... 84/603
See application file for complete search history.

(56) References Cited

U.S. PATENT DOCUMENTS 6,525,252 B1 * 2/2003 Klausen ..... G10H 1/0025 84/477 R
8,222,507 B1 * 7/2012 Salazar ..... G10H 1/0008 84/602
2005/0217464 A1 * 10/2005 Onozawa ..... G10H 1/055 84/723
2007/0017352 A1 * 1/2007 Masuda ..... G10H 1/053 84/658
2008/0047415 A1 2/2008 Schultz
2008/0087159 A1 * 4/2008 Heintz ..... G09B 15/00 84/470 R
2009/0020000 A1 * 1/2009 Onozawa ..... G10D 7/00 84/723
2009/0038463 A1 * 2/2009 Fujii ..... G10D 9/026 84/398
2012/0017749 A1 * 1/2012 Hashimoto ..... G10H 1/053 84/600
2012/0073424 A1 * 3/2012 Hashimoto ..... G10H 1/0008 84/622
2015/0027294 A1 * 1/2015 Johnson ..... G10D 9/02 84/383 R
2015/0101477 A1 * 4/2015 Park ..... G10H 7/002 84/633
2015/0348525 A1 * 12/2015 Nakae ..... G10H 1/0008 84/735
2016/0210949 A1 7/2016 Kang et al.

FOREIGN PATENT DOCUMENTS

JP 2013-195965 9/2013
KR 20-1993-0003352 U 2/1993
KR 10-1529109 B1 6/2015

* cited by examiner

MULTIFUNCTIONAL DIGITAL MUSICAL INSTRUMENT

CROSS-REFERENCE TO RELATED APPLICATION

This application claims priority to Korean Patent Application No. 10-2015-0010284, filed on Jan. 21, 2015, and Korean Patent Application No. 10-2015-0164410, filed on Nov. 24, 2015, and all the benefits accruing therefrom under 35 U.S.C. §119, the contents of which in their entirety are herein incorporated by reference.

BACKGROUND

1. Field

Exemplary embodiments of the invention relate to a multifunctional digital musical instrument, and more particularly, to a multifunctional digital musical instrument that allows a user to select one of a plurality of musical instruments to play, blow air into a mouthpiece of the selected musical instrument to produce an acoustic sound, and play the selected musical instrument.

2. Description of the Related Art

Recent progress and development of an electronic technique and a digital technique are prominent, and various electronic musical instruments such as an electronic wind instrument and an electronic keyboard instrument using the techniques have been developed and are widely used. Among these electronic musical instruments, some electronic keyboard instruments have a tone generation technique referred to as a coupler effect producing function which, even when one pitch is designated, generates a first tone or an original tone at a first pitch specified by the pitch designation and, at the same time, generates a second tone or a coupler tone at a second pitch different from the first pitch. According to an electronic keyboard instrument having this tone generation function, it is possible to simultaneously generate two musical tones having a predetermined pitch difference and enhance playing effects.

However, according to a conventional electronic wind instrument, an acoustic sound is output through an electronic keyboard instrument. Thus, there is a need to develop a digital musical instrument that allows a user to blow air to produce a realistic acoustic sound and thus experience realistic playing effects as though the user plays an acoustic musical instrument.

It is to be understood that this background of the technology section is intended to provide useful background for understanding the technology and as such disclosed herein, the technology background section may include ideas, concepts or recognitions that were not part of what was known or appreciated by those skilled in the pertinent art prior to a corresponding effective filing date of subject matter disclosed herein.

SUMMARY

Exemplary embodiments of the invention are directed to a multifunctional digital musical instrument that allows a user to select one of a plurality of musical instruments to play and blow air through a wind sensor unit, so as to emulate a sound of an acoustic musical instrument and produce a realistic acoustic sound.

According to an exemplary embodiment of the invention, an electronic musical instrument includes a database including timbre data corresponding to each type of a plurality of musical instruments an acoustic data input unit configured to display an acoustic data input position corresponding to a selected one of a plurality of musical instruments, detect whether the acoustic data input position is touched, and receive information on the touched acoustic data input position a mouthpiece provided in a detachable manner and having a shape corresponding to a shape of a mouthpiece of the selected musical instrument a wind sensor unit configured to measure an amount of externally supplied air, and generate loudness data based on the measured amount of air a control unit configured to receive, from the database, timbre data corresponding to the information on the touched acoustic data input position input from the acoustic data input unit, receive the loudness data from the wind sensor unit, and synthesize the timbre data and the loudness data to output an acoustic sound signal of the selected musical instrument and a power supply unit configured to supply power to the wind sensor unit, the acoustic data input unit, and the control unit.

The mouthpiece may include a first terminal unit configured to input information on a type of musical instrument.

The electronic musical instrument may further include a mouthpiece detecting sensor contacting the first terminal unit to receive the information on the type of musical instrument therefrom.

A number of the mouthpiece detecting sensors may be greater than or equal to a number of the first terminal units.

The electronic musical instrument may further include an acoustic sound storing unit configured to store the acoustic sound signal of the selected musical instrument.

The control unit may be configured to convert the acoustic sound signal of the selected musical instrument into an audio file and store the audio file in the acoustic sound storing unit.

The wind sensor unit may include a plurality of sensors.

The control unit may further include an octave adjusting unit configured to adjust a frequency of the acoustic sound signal of the selected musical instrument.

The acoustic data input unit may be configured to detect the acoustic data input position based on one of a capacitive touch scheme, a resistive touch scheme, and an ultrasonic location sensing scheme.

The acoustic data input unit may be unitary with a display panel configured to display the acoustic data input position.

The acoustic data input unit may further include a pressure sensor configured to measure a level of a pressure applied to the acoustic data input position, and the control unit is configured to change a frequency of the acousic sound signal of the selected musical instrument corresponding to the measured level of the pressure.

The pressure sensor may include one of a capacitive displacement sensor, a piezoelectric sensor, and an electromagnetic induction sensor.

The electronic musical instrument may further include an acoustic data input position guide disposed at a position corresponding to the acoustic data input unit.

The acoustic data input position guide may have a portion corresponding to an acoustic data input position and a peripheral portion thereof which include different materials from one another.

The acoustic data input position guide may have one of a recessed portion, a protruding portion, and a hole at the portion thereof corresponding to the acoustic data input position.

The acoustic data input position guide may include a second terminal unit configured to input information on a type of musical instrument.

The electronic musical instrument may further include an acoustic data input position guide detecting sensor contacting the second terminal unit to receive the information on the type of musical instrument therefrom.

A number of the acoustic data input position guide detecting sensors may be greater than or equal to a number of the second terminal units.

The acoustic data input position guide may further include a pressure sensor configured to measure a level of a pressure applied to the acoustic data input position.

The pressure sensor may include one of a capacitive displacement sensor, a piezoelectric sensor, and an electromagnetic induction sensor.

The foregoing is illustrative only and is not intended to be in any way limiting. In addition to the illustrative exemplary embodiments, and features described above, further exemplary embodiments, and features will become apparent by reference to the drawings and the following detailed description.

BRIEF DESCRIPTION OF THE DRAWINGS

The above and other features and exemplary embodiments of the invention will be more clearly understood from the following detailed description taken in conjunction with the accompanying drawings, in which.

DETAILED DESCRIPTION

Exemplary embodiments will now be described more fully hereinafter with reference to the accompanying drawings.

Although the invention can be modified in various manners and have several exemplary embodiments, specific exemplary embodiments are illustrated in the accompanying drawings and will be mainly described in the specification. However, the scope of the exemplary embodiments of the invention is not limited to the specific exemplary embodiments and should be construed as including all the changes, equivalents, and substitutions included in the spirit and scope of the invention.

Figure 1:
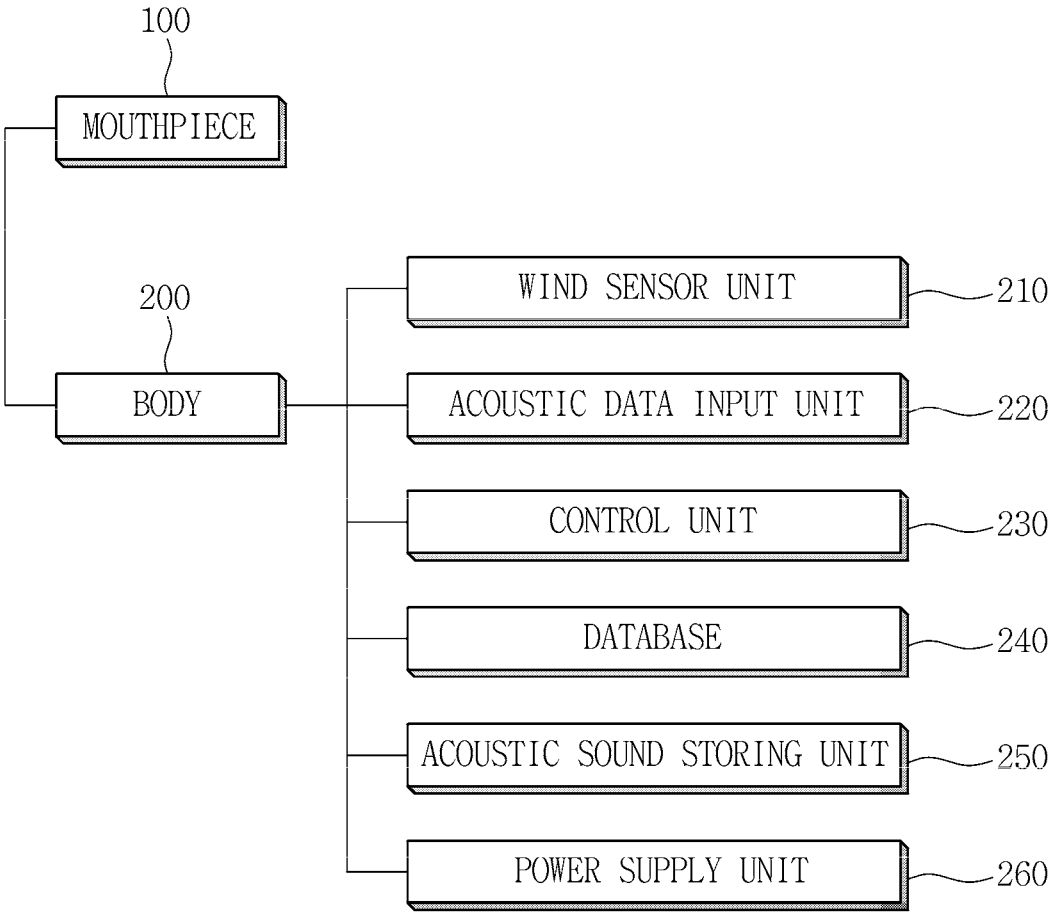
FIG. 1 is a block diagram illustrating a multifunctional digital musical instrument according to an exemplary embodiment.

FIG. 1 is a block diagram illustrating a multifunctional digital musical instrument according to an exemplary embodiment.

Figure 2:
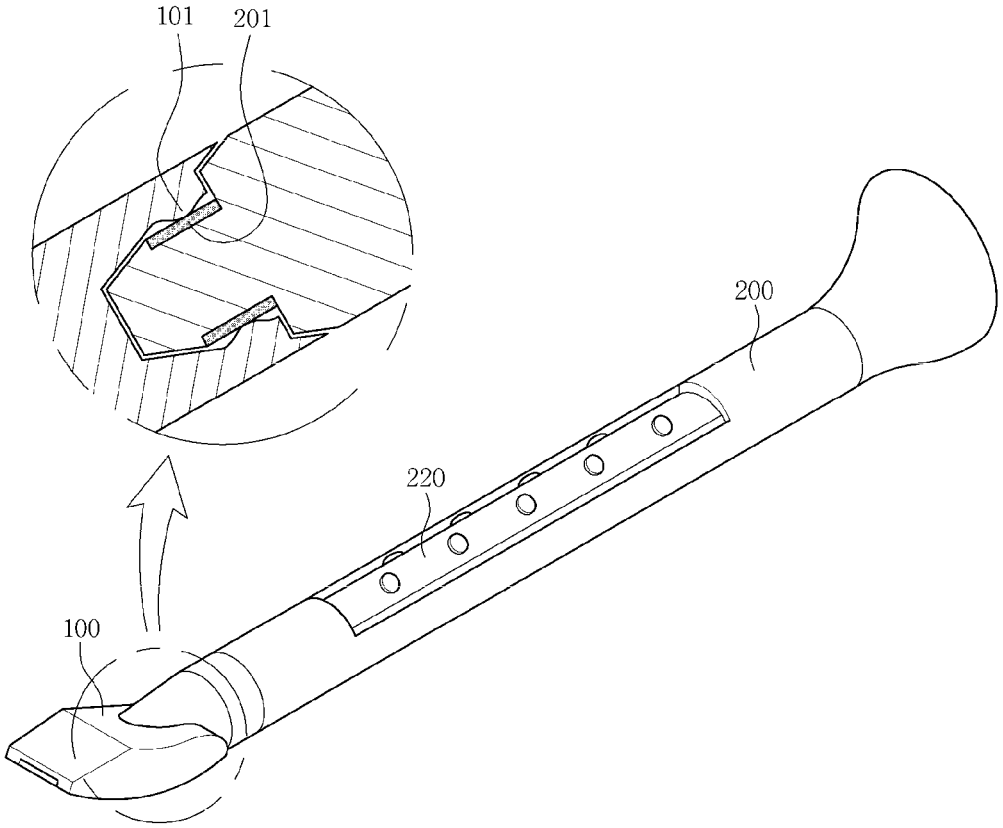
FIG. 2 is a perspective view illustrating a multifunctional digital musical instrument according to an exemplary embodiment.

FIG. 2 is a perspective view illustrating a multifunctional digital musical instrument according to an exemplary embodiment.

Figure 3A:
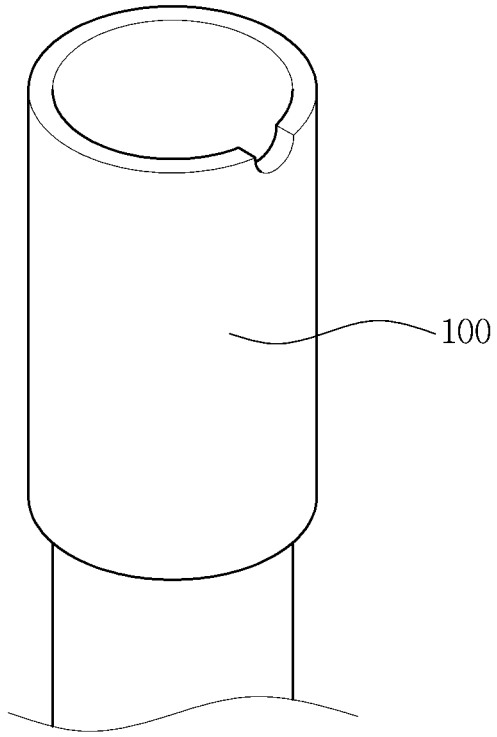
FIGS. 3A and 3B are perspective views illustrating examples of mouthpieces according to an exemplary embodiment.
Figure 3B:
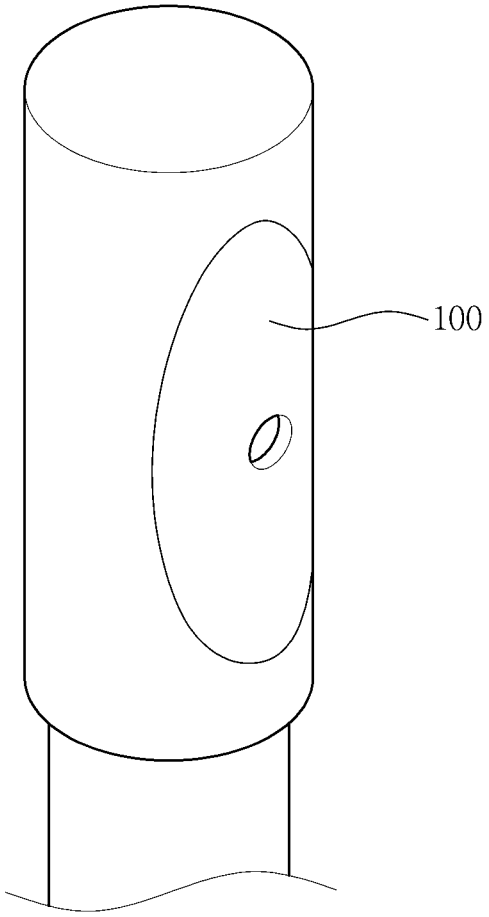

FIGS. 3A and 3B are perspective views illustrating examples of mouthpieces 100 according to an exemplary embodiment.

Figure 4:
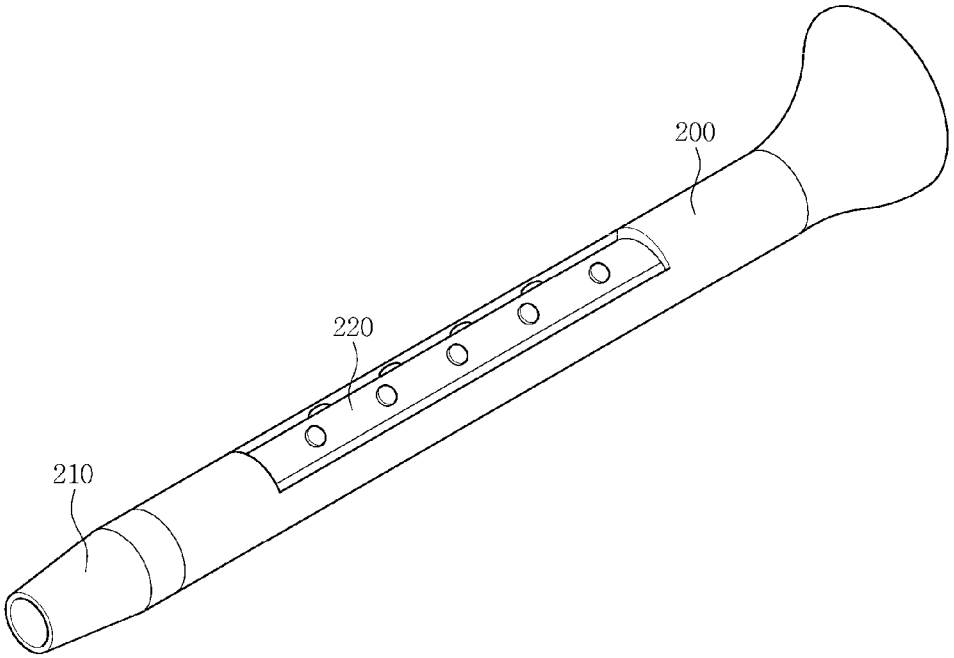
FIG. 4 is a perspective view illustrating a body according to an exemplary embodiment.

FIG. 4 is a perspective view illustrating a body 200 according to an exemplary embodiment.

Referring to FIGS. 1 and 2, the multifunctional digital musical instrument according to an exemplary embodiment includes a mouthpiece 100 and a body 200.

The mouthpiece 100 has a structure for externally supplying air thereto, and has a shape substantially similar to a shape of each corresponding mouthpiece of various musical instruments. In addition, the mouthpiece 100 may be coupled to the body 200. As illustrated in FIG. 3A, for example, a mouthpiece 100 that has a shape substantially similar to a shape of an embouchure of a Danso (i.e., a Korean notched, end-blown vertical bamboo flute) may be coupled to the body 200. On the other hand, as illustrated in FIG. 3B, for example, a mouthpiece 100 that has a shape substantially similar to a shape of a mouthpiece of a flute may be coupled to the body 200.

The mouthpiece 100 has a structure for inputting, to the body 200, information on a type of musical instrument corresponding to the type of the mouthpiece 100 by contacting the body 200. For example, as illustrated in FIG. 2, the mouthpiece 100 includes at least one first terminal unit 101.

As illustrated in FIG. 2, the first terminal unit 101 protrudes toward a mouthpiece detecting sensor 201. However, the shape of the first terminal unit 101 is not limited thereto, and the first terminal unit 101 may have a groove shape. In such an exemplary embodiment, the first terminal unit 101 may include metal. However, the material included in the first terminal unit 101 is not limited thereto, and the first terminal unit 101 may include any suitable material.

As illustrated in FIGS. 1, 2, 3A, 3B, and 4, the body 200 may further include the mouthpiece detecting sensor 201, a wind sensor unit 210, an acoustic data input unit 220, a control unit 230, a database 240, an acoustic sound storing unit 250, and a power supply unit 260.

The mouthpiece detecting sensor 201 may protrude or may be recessed corresponding to the shape of the first terminal unit 101.

The number of the mouthpiece detecting sensors 201 may be greater than or equal to the number of the first terminal units 101. In an exemplary embodiment, for example, in a case in which the body 200 includes a total of seven mouthpiece detecting sensors 201, the mouthpiece 100 of the Danso may include a total of three first terminal units 101, and the mouthpiece 100 of the flute may include a total of five first terminal units 101. In such an exemplary embodiment, in a case in which the mouthpiece 100 of the Danso and the body 200 are coupled to one another, only three of the seven mouthpiece detecting sensors 201 contact the three first terminal units 101 of the mouthpiece 100 of the Danso. The mouthpiece detecting sensor 201 transmits whether the first terminal unit 101 contacts the mouthpiece detecting sensor 201 to the control unit 230.

In an alternative exemplary embodiment, for example, in a case in which a mouthpiece 100 of one musical instrument is differentiated from that of another musical instrument only by an arrangement of the first terminal units 101 while all musical instruments have the same number of the first terminal units 101, the mouthpiece detecting sensor 201 detects a position of each of the first terminal units 101 and transmits information on the detected position to the control unit 230, and the control unit 230 may determine the type of mouthpiece 100 and the type of musical instrument based on the information on the detected position of the first terminal unit 101 transmitted from the mouthpiece detecting sensor 201.

As such, the body 200 may identify a type of musical instrument based on combined information on the number and the position of the first terminal units 101 arranged in the mouthpiece 100.

The wind sensor unit 210 is configured to calculate an amount of respiratory air from a user, and provides loudness data to the control unit 230. The wind sensor unit 210 may include any suitable type of wind sensor unit that is configured to measure an amount of respiratory air. The wind sensor unit 210 may be included in the body 200. In such an exemplary embodiment, the wind sensor unit 210 may be mounted in the mouthpiece 100.

Figure 5A:
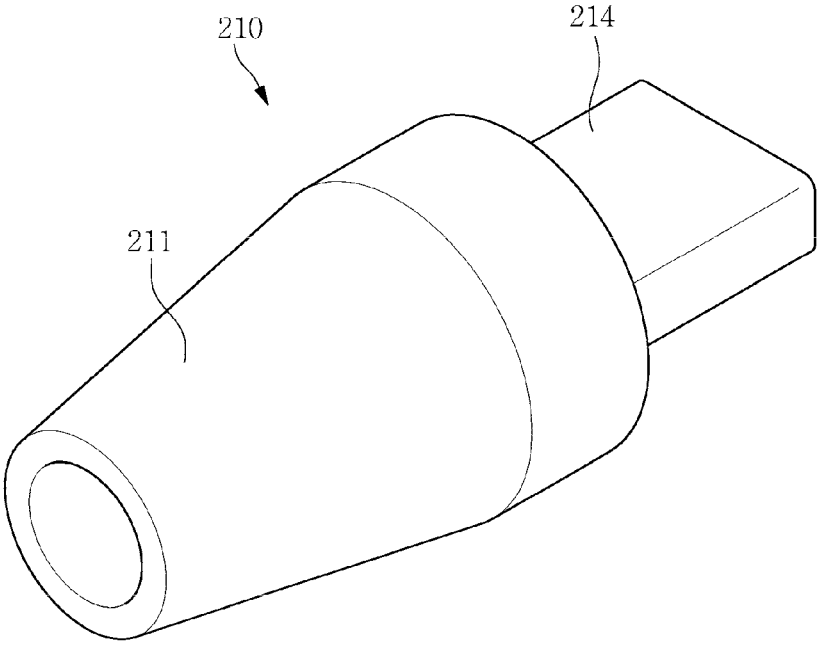
FIG. 5A is a perspective view illustrating a wind sensor unit according to an exemplary embodiment.
Figure 5B:
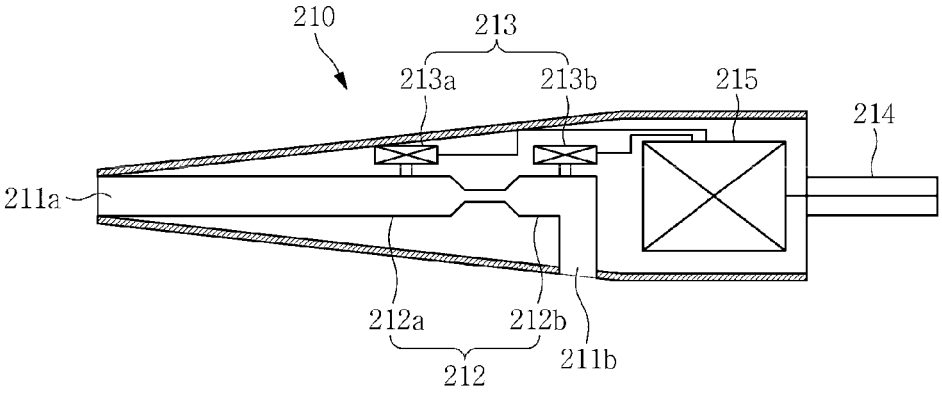
FIG. 5B is a cross-sectional view illustrating the wind sensor unit of FIG. 5A.

FIG. 5A is a perspective view illustrating the wind sensor unit 210 according to an exemplary embodiment. FIG. 5B is a cross-sectional view illustrating the wind sensor unit 210 of FIG. 5A.

Referring to FIGS. 5A and 5B, the wind sensor unit 210 includes a housing 211, a tube 212, a sensing portion 213, a data communication portion 214, and an air amount calculating portion 215.

The tube 212, the sensing portion 213, and the air amount calculating portion 215 are positioned in the housing 211. The housing 211 includes a mouthpiece coupling portion 211*a* disposed at one side thereof, and has an outlet hole 211*b* disposed in one surface thereof. The mouthpiece coupling portion 211*a* is coupled to the mouthpiece 100, and a respiratory air from a user flows from the mouthpiece 100 to the mouthpiece coupling portion 211*a*.

The tube 212 is positioned in the housing 211, and guides the respiratory air from the user. The tube 212 includes an inlet 212*a* having one end connected to the mouthpiece coupling portion 211*a*, and includes an outlet 212*b* having one end connected to the outlet hole 211*b*. The tube 212 may be provided in an inclined manner in a direction from the mouthpiece coupling portion 211*a* to the outlet hole 211*b* so that the respiratory air of the user being applied thereto may be supplied without loss. Accordingly, when the respiratory air is applied to the mouthpiece coupling portion 211*a*, the respiratory air is discharged through the outlet hole 211*b* across the tube 212. In this manner, the respiratory air applied to the mouthpiece coupling portion 211*a* is substantially entirely guided to the outlet hole 211*b* without loss, due to the tube 212 which is built in the housing 211. For example, a cross-sectional thickness of the tube 212 taken along a center portion thereof may be less than a cross-sectional thickness of each of the inlet 212*a* and the outlet 212*b*, so that resistance may be formed at the center portion of the tube 212. Accordingly, the center portion of the tube 212 has a structure similar to an orifice structure.

The sensing portion 213 may include a plurality of pressure sensors. As illustrated in FIG. 5B, in an exemplary embodiment, the sensing portion 213 includes a first pressure sensor 213*a* and a second pressure sensor 213*b*, and the first pressure sensor 213*a* and the second pressure sensor 213*b* are positioned in the tube 212. Each of the first pressure sensor 213*a* and the second pressure sensor 213*b* is configured to measure a level of a pressure generated by the respiratory air applied to the mouthpiece coupling portion 211*a*. In detail, the first pressure sensor 213*a* is disposed at the inlet 212*a* of the tube 212 and the second pressure sensor 213*b* is disposed at the outlet 212*b* of the tube 212, such that pressure levels in the inlet 212*a* and the outlet 212*b* respectively positioned in front of and behind the center portion of the tube 212 may be measured. In such an exemplary embodiment, the first pressure sensor 213*a* and the second pressure sensor 213*b* are not limited to a particular type or kind, and any suitable type of pressure sensor that is configured to measure a variation in a pressure level of a fluid may be employed.

The sensing portion 213 may include a plurality of air flow velocity sensors. The air flow velocity sensor measures a velocity of air being applied, and the measured velocity of air may be converted into pressure based on the Bernoulli's equation.

The data communication portion 214 is connected to the control unit 230 so as to transmit and/or receive information thereto and/or therefrom, and may be disposed in the wind sensor unit 210 in a direction opposite to the mouthpiece coupling portion 211*a*. To connect the data communication portion 214 and the control unit 230 to one another, the data communication portion 214 may use its own communication protocols, wired communication protocols, and/or wireless communication protocols. Examples of the wired communication protocols may include one or more of universal serial bus ("USB"), programmable logic controller ("PLC"), local area network ("LAN"), recommended standard 232 (RS-232), RS-485, RS-422, The Institute of Electrical and Electronics Engineers ("IEEE") 1394, and Home Phoneline Networking Alliance (HomePNA). Examples of the wireless communication protocols may include one or more of ZigBee, dedicated short-range communication ("DSRC"), radio-frequency identification ("RFID"), Bluetooth, wireless local area network ("WLAN"), wireless fidelity (Wi-Fi), and Wireless Broadband (WiBro).

The air amount calculating portion 215 calculates an amount of air based on the principle of orifice flowmeter. An orifice flowmeter is a flowmeter in which an orifice plate is fitted in a pipeline so as to measure respective pressure levels of a fluid flowing upstream and downstream of the orifice plate and calculate a volumetric flow rate of the fluid. As a cross-sectional planar area of the pipeline through which the fluid flows decreases, resistance is generated such that the pressure level of the fluid flowing upstream of the orifice plate (i.e., upstream pressure) and the pressure level of the fluid flowing downstream of the orifice plate (i.e., downstream pressure) differ from one another. As the volumetric flow rate of the fluid flowing through the pipeline is proportional to the difference between the upstream pressure level and the downstream pressure level of the fluid across the orifice plate, the volumetric flow rate of the fluid may be obtained by calculating the difference between the upstream pressure level and the downstream pressure level of the fluid across the orifice plate. In an exemplary embodiment, the air amount calculating portion 215 calculates a difference between the pressure level measured in the first pressure sensor 213*a* and the pressure level measured in the second pressure sensor 213*b*, to thereby calculate an amount of air. The calculated amount of air is converted into loudness data and is transmitted to the control unit 230 through the data communication portion 214.

The acoustic data input unit 220 is positioned in the body 200, is configured to display a selection list of a plurality of musical instruments and display an acoustic data input position corresponding to a selected one of the plurality of musical instruments. The acoustic data input unit 220 is an input pad based on one of a capacitive touch scheme, a resistive touch scheme, and an ultrasonic location sensing scheme, and receives information on a touched acoustic data input position.

The acoustic data input unit 220 may further include a pressure sensor configured to measure a level of a pressure being applied to the acoustic data input position. The pressure sensor may include one of a capacitive displacement sensor, a piezoelectric sensor, and an electromagnetic induction sensor. Based on the level of the pressure measured by the pressure sensor at the acoustic data input position, the control unit 230 is configured to minutely change a frequency of an acoustic sound signal, such that the multifunctional digital musical instrument may emulate a sound of an acoustic musical instrument and may produce a realistic acoustic sound.

Figure 6A:
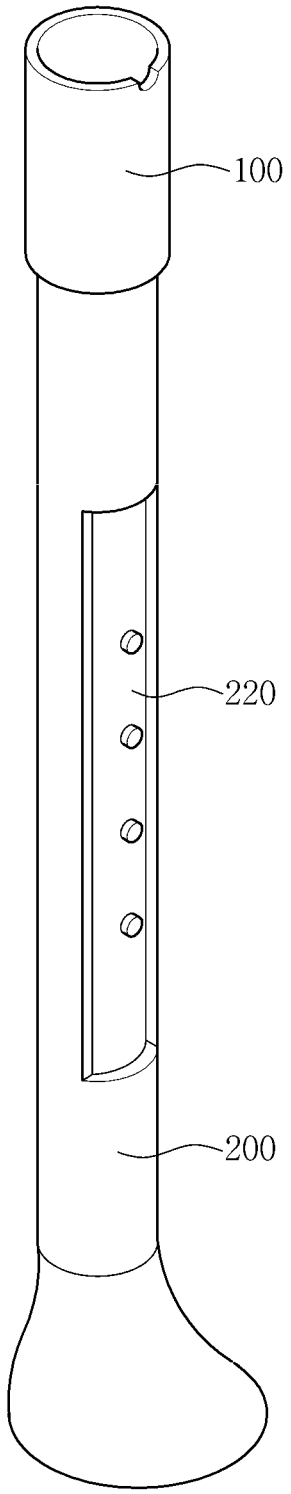
FIGS. 6A and 6B are perspective views illustrating examples of multifunctional digital musical instruments according to an exemplary embodiment.
Figure 6B:
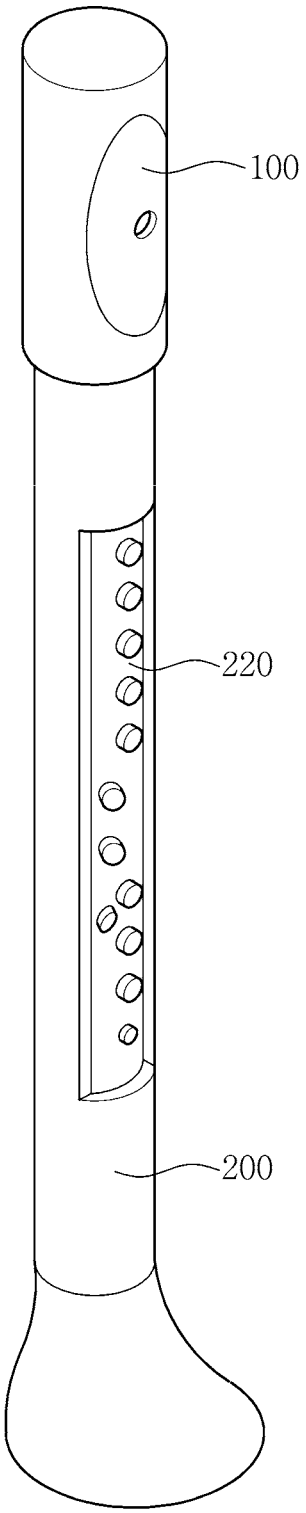

FIGS. 6A and 6B are perspective views illustrating examples of multifunctional digital musical instruments according to an exemplary embodiment.

Figure 7:
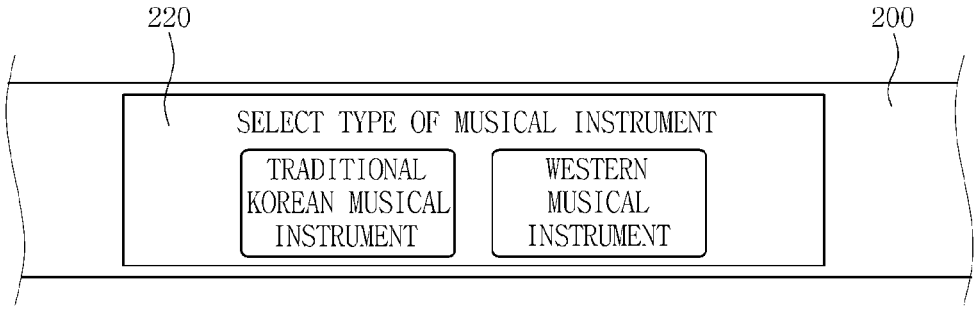
FIG. 7 is a plan view illustrating an acoustic data input unit according to an exemplary embodiment.

FIG. 7 is a plan view illustrating the acoustic data input unit 220 according to an exemplary embodiment.

Referring to FIGS. 6A, 6B, and 7, the acoustic data input unit 220 may be unitary with a display panel on which an acoustic data input position is displayed. Accordingly, the display panel of the acoustic data input unit 220 is configured to display a plurality of acoustic data input positions, and the acoustic data input unit 220 is configured to receive information on one of the plurality of displayed acoustic data input positions that is touched by a user. In such an exemplary embodiment, the display panel may include one of a light emitting diode ("LED") display panel, a liquid crystal display ("LCD") panel, an organic light emitting diode ("OLED") display panel, and an electrophoretic display ("EPD") panel.

Referring to FIGS. 6A and 6B, the acoustic data input unit 220 may display an acoustic data input position corresponding to a position of a button or a hole of a musical instrument to play, and may receive information on a touched acoustic data input position. For example, as illustrated in FIGS. 6A and 6B, in a case in which one of a Danso and a flute is selected, the acoustic data input unit 220 displays an acoustic data input position corresponding to a position of a hole of the Danso or a position of a button of the flute, and receives information on a touched acoustic data input position through the displayed acoustic data input position.

Referring to FIG. 7, the acoustic data input unit 220 may display, through the display panel, other information aside from the information on the touched acoustic data input position. For example, the display panel may display a selection list of a plurality of musical instruments to play, and may display acoustic data of a musical instrument being played, such as a type thereof, a sound volume, an octave, and the like.

The control unit 230 is configured to receive, from the mouthpiece detecting sensor 201, whether the first terminal unit 101 of the mouthpiece 100 contacts the mouthpiece detecting sensor 201 so as to determine a type of musical instrument, and is configured to display the type of musical instrument through the acoustic data input unit 220. In addition, the control unit 230 is configured to receive, from the database 240, timbre data corresponding to the determined type of musical instrument.

The control unit 230 receives information on the three elements of sound including loudness (i.e., amplitude) data, pitch data, and timbre data from the wind sensor unit 210, the acoustic data input unit 220, and the database 240, respectively.

For example, the control unit 230 receives loudness data from the wind sensor unit 210 which measures an amount of respiratory air from a user, and receives pitch data from the acoustic data input unit 220 which receives information on a touched acoustic data input position. In addition, the control unit 230 receives, from the database 240, timbre data corresponding to a type of musical instrument selected by a user.

Accordingly, the control unit 230 receives, from the database 240, the timbre data corresponding to the selected type of musical instrument and corresponding to the information on the touched acoustic data input position, and synthesizes the timbre data and the loudness data, which is input from the wind sensor unit 210, to output an acoustic sound signal of the selected musical instrument.

Although not illustrated, the control unit 230 may include an octave adjusting unit configured to adjust a frequency of the acoustic sound of the selected musical instrument. The octave adjusting unit may be disposed in the body 200 in the form of a separate button. The octave adjusting unit may adjust a frequency of a note of a desired musical scale into a frequency of two to the power of "n", i.e., $2^n$, ("n" being a real number), so as to change a note of the acoustic sound of the selected musical instrument in one octave to a note in another octave in the same musical scale. For example, in playing the note "Do" (i.e., at the pitch of middle "C" in the fixed-Do solfège scale) having a frequency of 262 Hz, when the octave adjusting unit raises one octave, an acoustic sound of a note "Do" having a frequency of two times 262 Hz is output, and when the octave adjusting unit lowers one octave, an acoustic sound of a note "Do" having a frequency of one half of 262 Hz is output. In such an exemplary embodiment, the control unit 230 may synthesize the information on the touched acoustic data input position input from the acoustic data input unit 220 and octave data input from the octave adjusting unit, and may output an acoustic sound signal.

The control unit 230 may minutely change the frequency of the acoustic sound signal based on the level of the pressure measured by the pressure sensor of the acoustic data input unit 220. In such an exemplary embodiment, the control unit 230 synthesizes information on the pressure measured by the pressure sensor and the information on the touched acoustic data input position, receives the timbre data corresponding to the information on the touched acoustic data input position from the database 240, and outputs the acoustic sound signal.

In addition, the control unit 230 is configured to convert the acoustic sound signal into an audio file format and store the audio file in the acoustic sound storing unit 250. For example, the acoustic sound signal may be converted into Waveform Audio File Format ("WAV"), a Free Lossless Audio Codec ("FLAC") format, a True Audio ("TTA") format, an MPEG-1 or MPEG-2 Audio Layer III ("MP3") format, or an Advanced Audio Coding ("ACC") format, so as to be stored in the acoustic sound storing unit 250.

The control unit 230 may transmit the audio file stored in the acoustic sound storing unit 250 to an external terminal, for example, a personal computer ("PC"), or a smartphone.

As necessary, the control unit 230 may output the stored audio file to a built-in amplifier or an external amplifier, and may produce an acoustic sound.

The database 240 includes timbre data corresponding to each type of a plurality of musical instruments. When one of the plurality of musical instruments is selected, the database 240 provides timbre data of the selected musical instrument to the control unit 230, and more particularly, timbre data corresponding to information on a touched acoustic data input position input by a user.

The body 200 may further include a built-in amplifier and a built-in speaker. The built-in amplifier may amplify an acoustic sound signal which is output from the control unit 230. The built-in speaker may convert the acoustic sound signal amplified by the control unit 230 or the built-in and/or external amplifier into an acoustic sound, and may output the acoustic sound. As such, the multifunctional digital musical instrument may output an acoustic sound by itself through the use of the built-in amplifier and the built-in speaker.

The body 200 includes a connection terminal so as to be connected to an external amplifier and to an external speaker therethrough. The external amplifier may amplify an acoustic sound signal which is output from the control unit 230. The external speaker may convert the acoustic sound signal amplified by the control unit 230 or the built-in and/or external amplifier into an acoustic sound, and may output the acoustic sound. The connection terminal positioned at the body 200 is connected to the external amplifier and the external speaker so as to output an acoustic sound externally of the multifunctional digital musical instrument. To this end, the body 200 may include a connection terminal based on its own communication protocols, or a connection terminal based on wired communication protocols and/or wireless communication protocols. Examples of the wired communication protocols may include one or more of USB, PLC, LAN, RS-232, RS-485, RS-422, IEEE 1394, and HomePNA. Examples of the wireless communication protocols may include one or more of ZigBee, DSRC, RFID, Bluetooth, WLAN, Wi-Fi, and WiBro.

The power supply unit 260 is configured to supply power to the wind sensor unit 210, the acoustic data input unit 220, and the control unit 230 so that the multifunctional digital musical instrument may operate.

Figure 8:
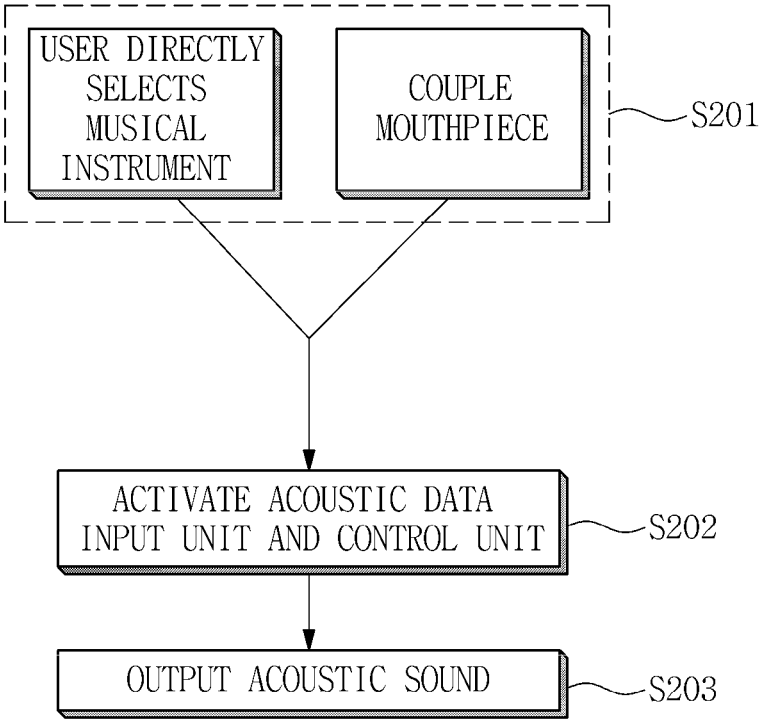
FIG. 8 is a flowchart illustrating a playing mechanism for a multifunctional digital musical instrument according to an exemplary embodiment.

FIG. 8 is a flowchart illustrating a playing mechanism for the multifunctional digital musical instrument according to an exemplary embodiment.

Referring to FIG. 8, the playing mechanism for the multifunctional digital musical instrument according to an exemplary embodiment will be described in greater detail.

In operation S201, a musical instrument to play is selected. The musical instrument to play may be selected in various manners. In an exemplary embodiment, for example, a user may directly select the musical instrument to play through a selection list displayed at the acoustic data input unit 220.

In an alternative exemplary embodiment, for example, in a case in which a mouthpiece 100 corresponding to a mouthpiece type of a musical instrument to play is coupled to the body 200, the mouthpiece detecting sensor 201 of the body 200 inputs, to the control unit 230, information on a type of musical instrument corresponding to the type of the mouthpiece 100 being coupled to the body 200, and the control unit 230 may receive the information on the type of musical instrument from the mouthpiece detecting sensor 201, such that the musical instrument to play may be automatically selected corresponding to the type of the mouthpiece 100 being coupled to the body 200.

In operation S202, the musical instrument is activated. Based on the selected type of musical instrument, the acoustic data input unit 220 displays an acoustic data input position, and the control unit 230 receives timbre data from the database 240.

In operation S203, the musical instrument is played. The wind sensor unit 210 transmits loudness data corresponding to an amount of respiratory air from a user to the control unit 230, and the acoustic data input unit 220 outputs information on an acoustic data input position that is touched by a user to the control unit 230. The timbre data input to the control unit 230 corresponds to the information on the touched acoustic data input position. The control unit 230 synthesizes the loudness data and the timbre data corresponding to the information on the touched acoustic data input position, and outputs an acoustic sound signal.

For example, when a user plays a Danso, the acoustic data input unit 220 receives, directly from the user, information indicating that the user selects the Danso, or alternatively, a mouthpiece 100 corresponding to the Danso is coupled to the body 200 such that a musical instrument to play, in this case, the Danso, is selected. In such an exemplary embodiment, the acoustic data input unit 220 displays an acoustic data input position corresponding to a position of a hole of the Danso, and the control unit 230 receives timbre data of the Danso from the database 240. The user blows air into the mouthpiece 100 and touches the acoustic data input position displayed at the acoustic data input unit 220 to play the multifunctional digital musical instrument.

Figure 9:
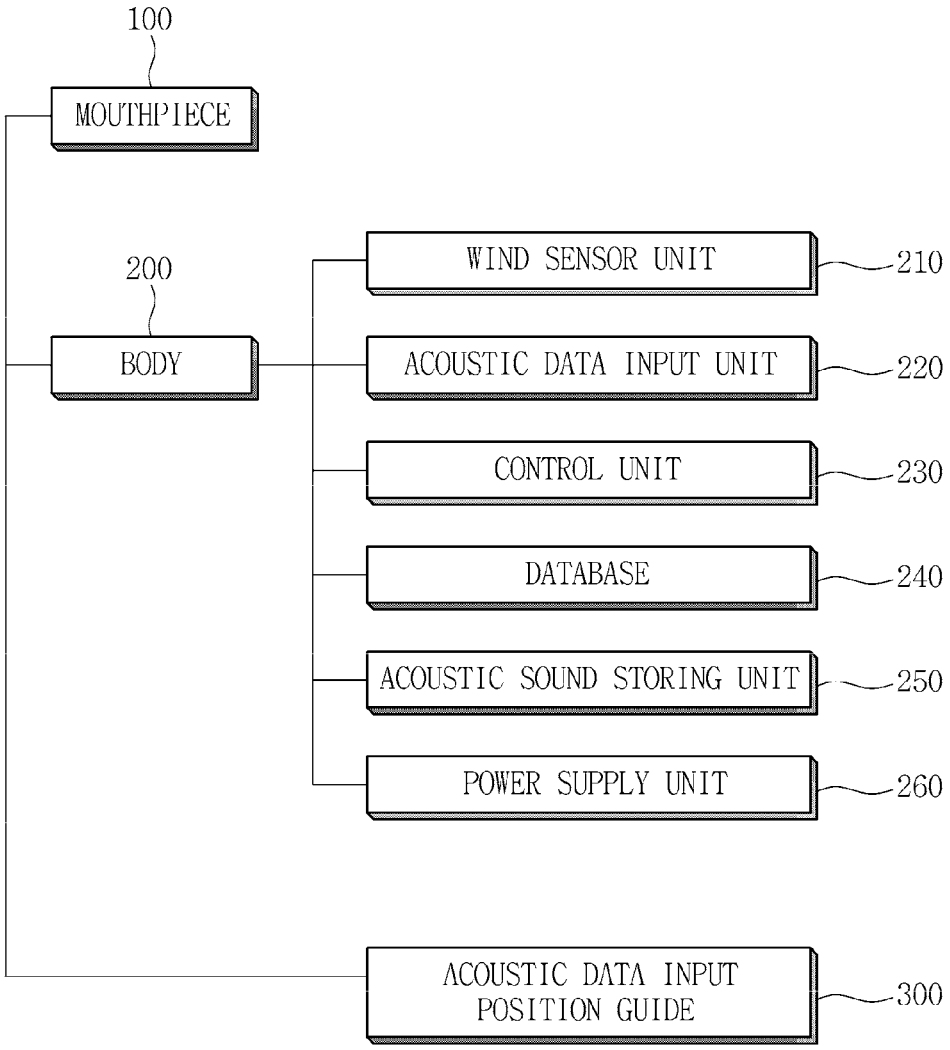
FIG. 9 is a block diagram illustrating a multifunctional digital musical instrument according to another exemplary embodiment.
Figure 10:
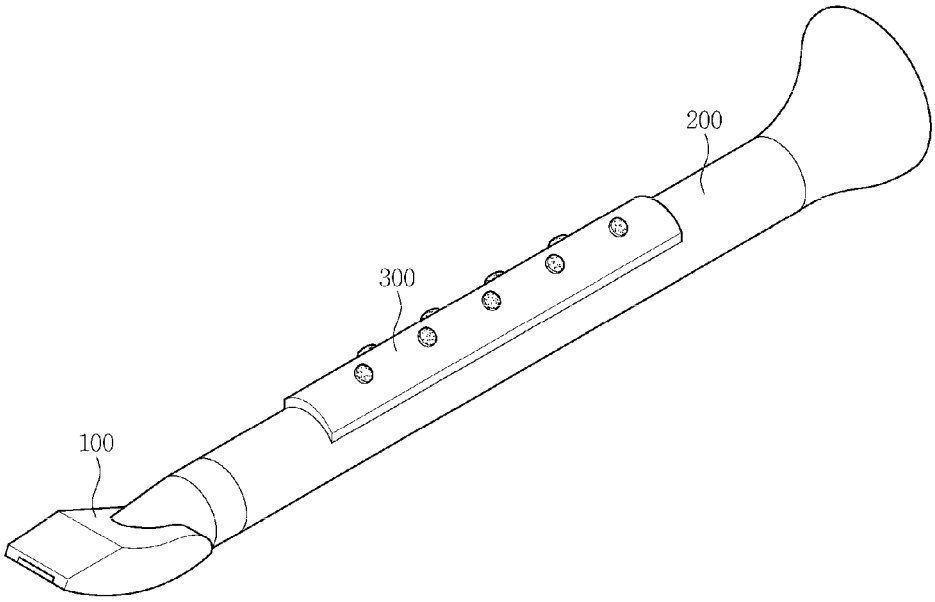
FIG. 10 is a perspective view illustrating a multifunctional digital musical instrument according to another exemplary embodiment.
Figure 11:
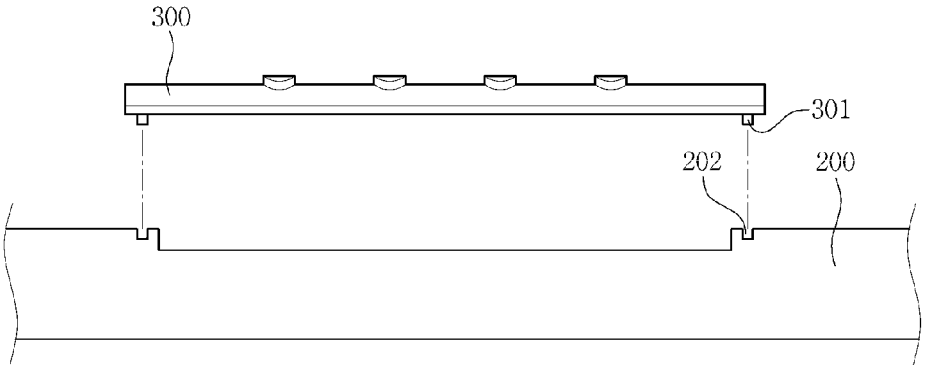
FIG. 11 is a cross-sectional view illustrating an acoustic data input position guide and a body according to another exemplary embodiment.
Figure 12A:
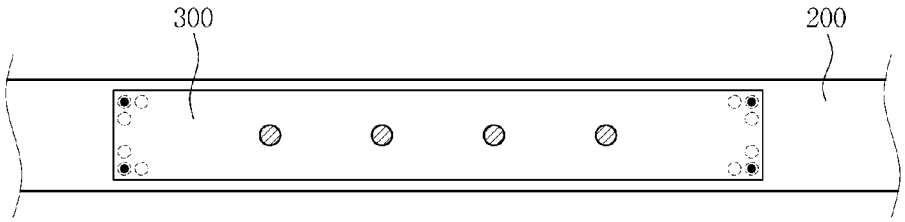
FIGS. 12A and 12B are plan views illustrating examples of acoustic data input position guides according to another exemplary embodiment.
Figure 12B:
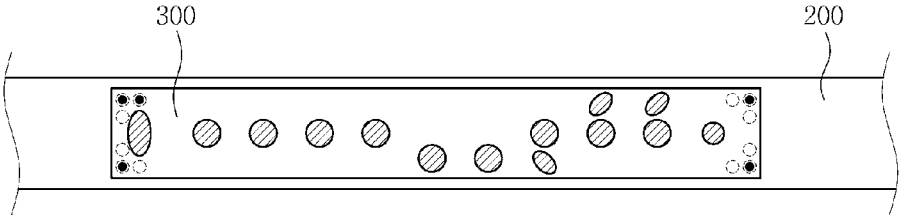
Figure 13A:
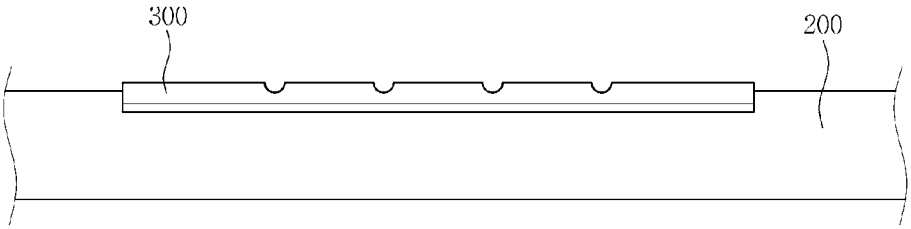
FIGS. 13A and 13B are cross-sectional views illustrating examples of acoustic data input position guides according to another exemplary embodiment.
Figure 13B:
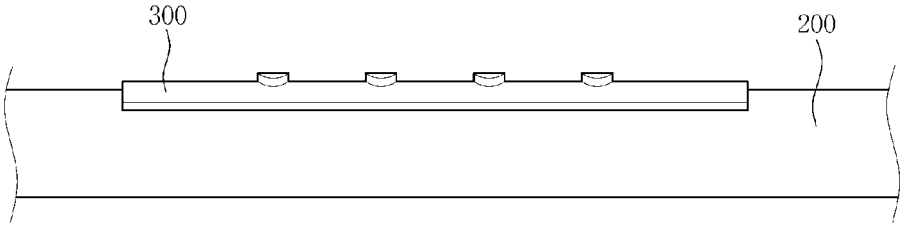

FIG. 9 is a block diagram illustrating a multifunctional digital musical instrument according to another exemplary embodiment. FIG. 10 is a perspective view illustrating a multifunctional digital musical instrument according to another exemplary embodiment. FIG. 11 is a cross-sectional view illustrating an acoustic data input position guide 300 and a body 200 according to another exemplary embodiment. FIGS. 12A and 12B are plan views illustrating examples of acoustic data input position guides 300 according to another exemplary embodiment. FIGS. 13A and 13B are cross-sectional views illustrating examples of acoustic data input position guides 300 according to another exemplary embodiment.

A description on the same configuration as the configuration described in the foregoing with respect to an exemplary embodiment will be omitted herein for conciseness.

Referring to FIGS. 9 and 10, the multifunctional digital musical instrument according to another exemplary embodiment includes a mouthpiece 100, a body 200, and an acoustic data input position guide 300.

The acoustic data input position guide 300 has a surface to be touched by a user, and has a hole or a button corresponding to each type of a plurality of musical instruments. In addition, the acoustic data input position guide 300 may be coupled to the body 200 in a detachable manner.

The acoustic data input position guide 300 may have a structure for inputting information on a type of musical instrument corresponding to a type of the acoustic data input position guide 300 to the body 200 through being coupled to the body 200, similarly to the structure of the mouthpiece 100.

For example, as illustrated in FIG. 11, the acoustic data input position guide 300 includes at least one second terminal unit 301.

As illustrated in FIG. 11, the second terminal unit 301 protrudes toward the body 200. However, the shape of the second terminal unit 301 is not limited thereto, and the second terminal unit 301 may have a groove shape that is recessed toward the acoustic data input position guide 300. In such an exemplary embodiment, the second terminal unit 301 may include metal. However, the material included in the second terminal unit 301 is not limited thereto, and the second terminal unit 301 may include any suitable material.

As illustrated in FIG. 11, the body 200 may have an acoustic data input position guide detecting sensor 202 that protrudes or is recessed corresponding to the shape of the second terminal unit 301.

As illustrated in FIGS. 12A and 12B, the number of the acoustic data input position guide detecting sensors 202 is greater than or equal to the number of the second terminal units 301. In an exemplary embodiment, for example, in a case in which the body 200 includes three acoustic data input position guide detecting sensors 202 at each corner thereof, thus resulting in a total of 12 acoustic data input position guide detecting sensors 202, an acoustic data input position guide 300 of a Danso includes a total of four second terminal units 301, and an acoustic data input position guide 300 of a flute includes a total of five second terminal units 301. In such an exemplary embodiment, when the acoustic data input position guide 300 of the Danso and the body 200 are coupled to one another, only four of the 12 acoustic data input position guide detecting sensors 202 contact the four second terminal units 301 of the acoustic data input position guide 300 of the Danso. The acoustic data input position guide detecting sensor 202 transmits whether the second terminal unit 301 contacts the acoustic data input position guide detecting sensor 202 to a control unit 230.

In an alternative exemplary embodiment, for example, in a case in which an acoustic data input position guide 300 of one musical instrument is differentiated from that of another musical instrument only by an arrangement of the second terminal units 301 while all musical instruments have the same number of the second terminal units 301, the acoustic data input position guide detecting sensor 202 detects a position of each of the second terminal units 301 and transmits information on the detected position to the control unit 230, and the control unit 230 may determine the type of the acoustic data input position guide 300 and the type of musical instrument based on the information on the detected position of the second terminal unit 301 transmitted from the acoustic data input position guide detecting sensor 202.

As such, the body 200 may identify a type of musical instrument based on combined information on the number and the position of the second terminal units 301 arranged in the acoustic data input position guide 300.

As illustrated in FIGS. 12A and 12B, the acoustic data input position guide 300 has a portion corresponding to an acoustic data input position and a peripheral portion thereof which may include different materials from one another. The portion of the acoustic data input position guide 300 corresponding to the acoustic data input position and the peripheral portion thereof including different materials may have different textures from one another. Accordingly, an acoustic data input unit 220 may accurately receive information on a touched acoustic data input position from a user.

Referring to FIGS. 13A and 13B, the acoustic data input position guide 300 may have one of a recessed portion, a protruding portion, and a hole at the portion thereof corresponding to the acoustic data input position. When a user touches the acoustic data input position guide 300 having one of the recessed portion, the protruding portion, and the hole, the acoustic data input position guide 300 contacts the acoustic data input unit 220. Accordingly, the multifunctional digital musical instrument may emulate a sound of an acoustic musical instrument and may produce a realistic acoustic sound.

The acoustic data input position guide 300 may further include a pressure sensor configured to measure a level of a pressure being applied to the acoustic data input position. The pressure sensor may include one of a capacitive displacement sensor, a piezoelectric sensor, and an electromagnetic induction sensor. Based on the level of the pressure measured by the pressure sensor at the acoustic data input position, the control unit 230 is configured to minutely change a frequency of an acoustic sound signal, such that the multifunctional digital musical instrument may emulate a sound of an acoustic musical instrument and may produce a realistic acoustic sound.

The acoustic data input unit 220 is positioned in the body 200, displays a selection list of a plurality of musical instruments, and displays an acoustic data input position corresponding to a selected one of the plurality of musical instruments. The acoustic data input unit 220 is an input pad based on one of a capacitive touch scheme, a resistive touch scheme, and an ultrasonic location sensing scheme, and receives information on a touched acoustic data input position.

The acoustic data input unit 220 may display an acoustic data input position corresponding to a position of a button or a hole of a musical instrument to play, and may receive information on a touched acoustic data input position. For example, as illustrated in FIGS. 12A and 12B, in a case in which one of the Danso and the flute is selected, the acoustic data input unit 220 displays an acoustic data input position corresponding to a position of a hole of the Danso or a position of a button of the flute, and receives information on a touched acoustic data input position through the acoustic data input position guide 300.

As such, the acoustic data input unit 220 may, along with the acoustic data input position guide 300, differently display the acoustic data input position and the number of the acoustic data input positions based on the type of musical instrument.

The control unit 230 receives the information on the touched acoustic data input position transmitted from the acoustic data input position guide detecting sensor 202, selects a musical instrument to play, and receives timbre data of the selected musical instrument from the database 240.

The database 240 includes timbre data corresponding to each type of a plurality of musical instruments. When one of the plurality of musical instruments is selected, the database 240 provides timbre data of the selected musical instrument to the control unit 230, and more particularly, timbre data corresponding to information on a touched acoustic data input position input by a user.

Figure 14:
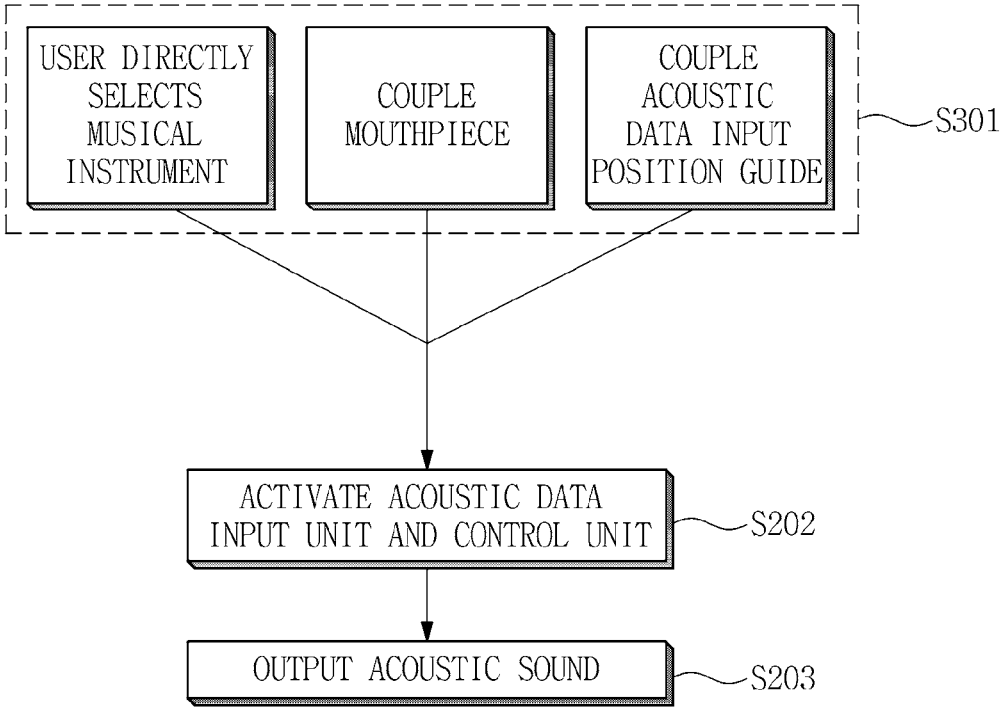
FIG. 14 is a flowchart illustrating a multifunctional digital musical instrument according to another exemplary embodiment.

FIG. 14 is a flowchart illustrating a playing mechanism for the multifunctional digital musical instrument according to another exemplary embodiment. Referring to FIG. 14, the playing mechanism for the multifunctional digital musical instrument according to another exemplary embodiment will be described in greater detail.

In operation S301, a musical instrument to play is selected. The musical instrument to play may be selected in various manners. In an exemplary embodiment, for example, a user may directly select the musical instrument to play through a selection list displayed at the acoustic data input unit 220. In an alternative exemplary embodiment, for example, in a case in which a mouthpiece 100 corresponding to a mouthpiece type of a musical instrument to play is coupled to the body 200, the musical instrument to play may be automatically selected. In such an exemplary embodiment, when the mouthpiece 100 is coupled to the body 200, the control unit 230 may receive information on the type of the mouthpiece 100 and a type of musical instrument corresponding thereto and thus, may select the type of musical instrument to play corresponding to the type of the mouthpiece 100 being coupled to the body 200. In an alternative exemplary embodiment, the acoustic data input position guide 300 may be coupled to the body 200, such that a musical instrument to play may be selected. In the case in which the acoustic data input position guide 300 is coupled to the body 200, the acoustic data input position guide 300 may input information on a type of musical instrument corresponding to the type of the acoustic data input position guide 300 to the control unit 230 through the acoustic data input position guide detecting sensor 202, and the control unit 230 may receive the information on the type of musical instrument from the acoustic data input position guide detecting sensor 202 and thus, may select the type of musical instrument to play corresponding to the type of the acoustic data input position guide 300.

In operation S302, the musical instrument is activated. Based on the selected type of musical instrument, the acoustic data input unit 220 displays an acoustic data input position, and the control unit 230 receives timbre data from the database 240.

In operation S303, the musical instrument is played. A wind sensor unit 210 transmits loudness data corresponding to an amount of respiratory air from a user to the control unit 230, and the acoustic data input unit 220 outputs information on an acoustic data input position that is touched by a user to the control unit 230. The timbre data input to the control unit 230 corresponds to the information on the touched acoustic data input position. The control unit 230 synthesizes the loudness data and the timbre data corresponding to the information on the touched acoustic data input position, and outputs an acoustic sound signal.

For example, when a user plays a Danso, the acoustic data input unit 220 receives, directly from the user, information indicating that the user selects the Danso, or alternatively, a mouthpiece 100 corresponding to the Danso is coupled to the body 200 or an acoustic data input position guide 300 corresponding to the Danso is coupled to the body 200, such that a musical instrument to play, in this case, the Danso, is selected. In such an exemplary embodiment, the acoustic data input unit 220 displays an acoustic data input position corresponding to a position of a hole of the Danso, and the control unit 230 receives timbre data of the Danso from the database 240. The user blows air into the mouthpiece 100 and touches the acoustic data input position displayed at the acoustic data input unit 220 corresponding to the position of the hole of the Danso to play the multifunctional digital musical instrument.

As set forth above, according to one or more exemplary embodiments, the multifunctional digital musical instrument may allow a user to select one of a plurality of musical instruments to play and blow air through the wind sensor unit, so as to produce a realistic acoustic sound based on a musical scale selection screen displayed on a touch panel.

In such exemplary embodiments, the multifunctional digital musical instrument may allow a user to experience realistic playing effects as though the user plays an acoustic musical instrument by coupling, to the wind sensor unit, the mouthpiece having a shape substantially similar to a shape of each corresponding mouthpiece of various musical instruments.

Accordingly, the multifunctional digital musical instrument that emulates a sound of an acoustic musical instrument and produces a realistic acoustic sound may be provided.

In such exemplary embodiments, a single multifunctional digital musical instrument may emulate the sounds of a variety of acoustic musical instruments, and may reduce costs of purchasing each of the musical instruments separately, which are generally rather expensive.

From the foregoing, it will be appreciated that various exemplary embodiments in accordance with the disclosure have been described herein for purposes of illustration, and that various modifications may be made without departing from the scope and spirit of the teachings. Accordingly, the various exemplary embodiments disclosed herein are not intended to be limiting of the true scope and spirit of the teachings. Various features of the above described and other exemplary embodiments can be mixed and matched in any manner, to produce further exemplary embodiments consistent with the invention.

What is claimed is:

1. An electronic musical instrument comprising:

a database comprising timbre data corresponding to each type of a plurality of musical instruments;

an acoustic data input unit configured to display an acoustic data input position corresponding to a selected one of the plurality of musical instruments, detect whether the acoustic data input position is touched, and receive information on the touched acoustic data input position;

a mouthpiece provided in a detachable manner and having a shape corresponding to a shape of a mouthpiece of the selected musical instrument, the mouthpiece being configured to input information on a type of a selected one of the plurality of musical instruments;

a wind sensor unit configured to measure an amount of externally supplied air, and generate loudness data based on the measured amount of air;

a control unit configured to determine which type of musical instrument to be played based on the information on the type of the selected one of the plurality of musical instruments from the mouthpiece, receive, from the database, timbre data corresponding to the information on the touched acoustic data input position input from the acoustic data input unit, receive the loudness data from the wind sensor unit, and synthesize the timbre data and the loudness data to output an acoustic sound signal of the selected musical instrument; and a power supply unit configured to supply power to the wind sensor unit, the acoustic data input unit, and the control unit.

2. The electronic musical instrument of claim 1, wherein the mouthpiece comprises a first terminal unit configured to input information on a type of musical instrument.

3. The electronic musical instrument of claim 2, further comprising a mouthpiece detecting sensor contacting the first terminal unit to receive the information on the type of musical instrument therefrom.

4. The electronic musical instrument of claim 3, wherein a number of the mouthpiece detecting sensors is greater than or equal to a number of the first terminal units.

5. The electronic musical instrument of claim 3, further comprising an acoustic sound storing unit configured to store the acoustic sound signal of the selected musical instrument.

6. The electronic musical instrument of claim 5, wherein the control unit is configured to convert the acoustic sound signal of the selected musical instrument into an audio file and store the audio file in the acoustic sound storing unit.

7. The electronic musical instrument of claim 3, wherein the wind sensor unit comprises a plurality of sensors.

8. The electronic musical instrument of claim 3, wherein the control unit further comprises an octave adjusting unit configured to adjust a frequency of the acoustic sound signal of the selected musical instrument.

9. The electronic musical instrument of claim 3, wherein the acoustic data input unit is configured to detect the acoustic data input position based on one of a capacitive touch scheme, a resistive touch scheme, and an ultrasonic location sensing scheme.

10. The electronic musical instrument of claim 3, wherein the acoustic data input unit is unitary with a display panel configured to display the acoustic data input position.

11. The electronic musical instrument of claim 3, wherein the acoustic data input unit further comprises a pressure sensor configured to measure a level of a pressure applied to the acoustic data input position, and the control unit is configured to change a frequency of the acoustic sound signal of the selected musical instrument corresponding to the measured level of the pressure.

12. The electronic musical instrument of claim 11, wherein the pressure sensor comprises one of a capacitive displacement sensor, a piezoelectric sensor, and an electromagnetic induction sensor.

13. The electronic musical instrument of claim 3, further comprising an acoustic data input position guide disposed at a position corresponding to the acoustic data input unit.

14. The electronic musical instrument of claim 13, wherein the acoustic data input position guide has a portion corresponding to an acoustic data input position and a peripheral portion thereof which comprise different materials from one another.

15. The electronic musical instrument of claim 13, wherein the acoustic data input position guide has one of a recessed portion, a protruding portion, and a hole at the portion thereof corresponding to the acoustic data input position.

16. The electronic musical instrument of claim 13, wherein the acoustic data input position guide comprises a second terminal unit configured to input information on a type of musical instrument.

17. The electronic musical instrument of claim 16, further comprising an acoustic data input position guide detecting sensor contacting the second terminal unit to receive the information on the type of musical instrument therefrom.

18. The electronic musical instrument of claim 17, wherein a number of the acoustic data input position guide detecting sensors is greater than or equal to a number of the second terminal units.

19. The electronic musical instrument of claim 17, wherein the acoustic data input position guide further comprises a pressure sensor configured to measure a level of a pressure applied to the acoustic data input position.

20. The electronic musical instrument of claim 19, wherein the pressure sensor comprises one of a capacitive displacement sensor, a piezoelectric sensor, and an electromagnetic induction sensor.

* * * * *